US006258129B1

(12) United States Patent
Dybdal et al.

(10) Patent No.: US 6,258,129 B1
(45) **Date of Patent: *Jul. 10, 2001**

(54) METHOD FOR ENZYMATIC TREATMENT OF WOOL

(75) Inventors: Lone Dybdal, Bagsvaerd (DK); Elisabeth Heine; Hartwig Hocker, both of Aachen (DE)

(73) Assignee: Novozymes A/S, Bagsvaerd (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/870,459

(22) Filed: Jun. 6, 1997

Related U.S. Application Data

(63) Continuation of application No. PCT/DK95/00517, filed on Dec. 21, 1995.

(30) Foreign Application Priority Data

Dec. 21, 1994 (DK) ..... 1451/94

(51) Int. Cl.[7] ..... D06M 10/02; D06M 16/00

(52) U.S. Cl. ..... 8/103; 8/111; 8/128.1; 8/128.3; 8/127.5; 8/115.52; 435/263

(58) Field of Search ..... 8/103, 111, 128.1, 8/128.3, 127.5, 115.52; 435/263

(56) References Cited

U.S. PATENT DOCUMENTS 4,533,359 * 8/1985 Kondo et al. ..... 8/128.1
6,103,068 * 8/2000 Merten et al. ..... 204/164

FOREIGN PATENT DOCUMENTS

4332692 * 7/1994 (DE) .
43 32 692 7/1994 (DE) .
0 358 386 3/1990 (EP) .
4-327274 * 11/1992 (JP) .
WO 89/03909 * 5/1989 (WO) .
WO 96/19611 * 6/1996 (WO) .

OTHER PUBLICATIONS

Byrne et al "Corona Discharge Treatment of Wool—Commercial Implications," in DWI Report, vol. 109, pp. 589–599, 1992.*

* cited by examiner

*Primary Examiner*—Alan Diamond
(74) *Attorney, Agent, or Firm*—Eliao J. Lambins, Esq.; Jason I. Garbell, Esq.

(57) ABSTRACT

The present invention relates to methods of producing wool or animal hair material with improved properties such as shrink-proofed (anti-felting tendency), increased whiteness, improved dyeability, increased softness and/or reduced pilling tendency, the method comprising the steps of treating wool, wool fibers or animal hair material in a process selected from the group consisting of plasma treatment processes and the Delhey process, and subjecting the wool or animal hair material to a treatment with a proteolytic enzyme (a protease), preferably a serine protease, more preferably a subtilisin, in an amount effective for improving the properties.

26 Claims, No Drawings

METHOD FOR ENZYMATIC TREATMENT OF WOOL

CROSS-REFERENCE TO RELATED APPLICATIONS

This application is a continuation application of PCT/DK95/00517 filed Dec. 21, 1995 and claims priority under 35 U.S.C. 119 of Danish application 1451/94 filed Dec. 21, 1994, the contents of which are fully incorporated herein by reference.

FIELD OF THE INVENTION

The present invention relates to a method of providing wool or animal hair with improved properties, e.g. reduced felting, increased whiteness, reduced pilling tendency, improved softness and improved dyeing characteristics, by enzymatic treatment. More specifically, the method comprises subjecting the wool or animal hair material to a plasma treatment and a treatment with a proteolytic enzyme, i.e. a protease.

BACKGROUND OF THE INVENTION

For many years, the wool industry has tried to develop methods to reduce felting of wool which do not result in release of damaging substances to the environment. Recent developments have pointed towards low-temperature plasma treatment or the Delhey process as possible solutions to this problem.

Thus, it is known to treat wool fibre material with electrical gas discharges (socalled plasma), i.e. in a dry process. Plasma treatment provides a changed surface finish of the wool fibre which reduces the tendency to felt, improves the printability and accelerates the dyeability of the wool. The use of plasma treatment in textile finishing, especially in wool finishing, is highly advantageous, since the process potentially is an environmentally acceptable alternative to the conventional chlorination finishing processes, cf. Byrne, K. M. et al.: *Corona discharge treatment of wool—commercial implications* in DWI Report, (1992), vol. 109, p. 589–599, (Aachener Textiltagung 1991).

In textile finishing, the applicable plasma treatment is a low-temperature or unbalanced plasma treatment ("cold plasma" treatment), in particular the corona discharge treatment and glow discharge treatment, cf. Thomas, H. et al.: *Environmentally friendly finishing processes for wool by pretreatment with electrical discharges in gas (plasma) in ITB* vol. 2, 1993. The corona discharge treatment is carried out under atmospheric conditions and is a weak-current discharge providing an oxidation, and thereby a polarization, of the fibre surface. The glow discharge treatment is carried out under reduced pressure, i.e. producing electrons of higher energy than is possible in the corona discharge treatment, and may modify the fibre surface more intensively.

Accordingly, the plasma treatment provides to the wool or animal hair material reduced felting tendency and improved dying characteristics without the use of damaging chemicals and without wastewater (dry process). Also, the treatment provides improved shrink-proof properties to the treated material which, however, at present cannot meet the demands of the end-users. Furthermore, the treatment may reduce the soft handle of the wool or animal hair material.

Published Japanese Patent Application Tokkai Hei 4-327274 discloses a method for a shrink-proofing treatment of e.g. wool fibers by subjecting the fibers to a low-temperature plasma treatment followed by treatment with a shrink-proofing resin, e.g. block-urethane resin, polyamide epochlorohydrin resin, glyoxalic resin, ethylene-urea resin or acrylate resin, and then a weight reducing treatment with a proteolytic enzyme for obtaining a softening effect.

The Delhey process is described in DE-A-43 32 692 and in J. Delhey: PhD Thesis, RWTH Aachen (1994). In this process the wool is treated in an aqueous solution of hydrogen peroxide in the presence of soluble wolframate, optionally followed by treatment in a solution or dispersion of synthetic polymers, for improving the anti-felting properties of the wool, However, neither does this treatment meet the demands of the end-users.

It is the object of the present invention to provide a method for treating wool or animal hair material to obtain wool or animal hair material with reduced felting tendency, improved softness, increased whiteness, reduced pilling tendency and/or improved dyeing characteristics, in an easy and a purely biological way without the use of environmentally damaging chemicals or resins.

SUMMARY OF THE INVENTION

Surprisingly, it has been found that certain properties of plasma-treated or Delhey-treated wool or animal hair may be improved by subjecting the plasma-treated or Delhey-treated wool or animal hair to a treatment with a proteolytic enzyme in an amount effective for providing the desired effect. Depending on the special characteristics of the actual wool subjected to the treatment according to the present invention, the improved properties can be reduction of felting tendency, higher whiteness, reduction of pilling tendency, improvement of softness, or improvement of dyeing characteristics.

Thus, according to the present invention it is possible to obtain good and satisfactory shrink-proofing properties without the use of a shrink-proofing polymer resin by treating the wool or animal hair material with a proteolytic enzyme either prior to or after a plasma treatment, preferably a low-temperature plasma treatment, or prior to or after a Delhey-treatment. Further to the improved shrink-proofing or anti-felting properties, the enzyme treatment can also improve the dyeing characteristics of the wool or animal hair material, provide a convenient bleaching (improved whiteness) and a reduced tendency of pilling, and provide the regain of the soft handle of the treated material.

Accordingly, the present invention relates to a method for producing wool or animal hair material with improved properties comprising the steps of a. pretreating wool, wool fibres or animal hair material in a process selected from the group consisting of plasma treatment processes and the Delhey process, and b. subjecting the pretreated wool or animal hair material to a treatment with a proteolytic enzyme (a protease) in an amount effective for improving the properties.

It is contemplated that the treatment with a proteolytic enzyme can take place prior to the plasma treatment or after the plasma treatment, either in a separate step or e.g. in combination with the scouring or the dyeing of the wool or animal hair material. Further, a surfactant or a softener can be present in the enzyme treatment step, or a separate step wherein the wool or animal hair material is subjected to a softening treatment can be applied.

By using the method of the present invention, it is possible to eliminate the use of environmentally damaging chemicals, since the present method is only using environmetally-friendly biological substances, and obtain improved properties of the treated wool or animal hair material which are highly desired by the end-user.

In another aspect, the present invention further relates to wool or animal hair material which has been treated according to the method of the present invention.

DETAILED DESCRIPTION OF THE INVENTION

In the present context, the terms "shrink-proof" and "anti-felting" are intended to mean a highly reduced tendency to shrinkage or felting after soaking, washing or rinsing the material in question as compared to the tendency of shrinking or felting of material which has not been subjected to a shrink-proof or anti-felting treatment. More specifically, the present invention provides a method for producing wool or animal hair material having improved shrink-proof or anti-felting properties.

Preferably, the shrink-proof improvement of plasma and enzyme treated wool or animal hair material corresponds to an area shrinkage which is less than 10%, more preferably less that 8%, more preferably less that 7%, more preferably less that 5%, even more preferably less than 3%, especially less that 2%, after 2 cycles of ISO 5A; or to an area shrinkage of less than 15%, more preferably less than 10%, more preferably less that 8%, even more preferably less than 6%, especially less that 5%, after 5 cycles of ISO 5A; measured according to the IWS Test Method 31.

Preferably, the shrink-proof improvement of wool or animal hair material treated in the Delhey process followed by an enzymatic treatment corresponds to an area shrinkage which is less than 25%, more preferably less that 20%, more preferably less that 15%, more preferably less that 12%, more preferably less that 10%, more preferably less than 8%, even more preferably less than 5%, especially less that 2%, after 2 cycles of ISO 5A, or to an area shrinkage of less than 20%, more preferably less that 15%, more preferably less than 12%, even more preferably less than 10%, especially less that 9%, after 5 cycles of ISO 5A, measured according to the IWS Test Method 31.

The IWS Test Method 31 which is available from The International Wool Secretariat is applicable to all washable wool textiles and to intermediate products including tops, hand knitting yarn, machine knitting yarn, weaving yearn and fabric for cut and sew use. The test may be used to determine the relaxation and the felting behaviour of an intermediate product. The relaxation shrinkage is determined from the dimensions of the sample befor and after subjecting the sample to wet relaxation with mild agitation. This relaxation is achieved by the International Standards Organisation International Standard ISO 6330 7A programme but differs in that the load is reduced to 1 kg. After relaxation, the felting shrinkage is determined from the dimensions of the sample before and after subjecting it to a severe agitation. This agitation is achieved by the ISO 6330 5A programme but differs in that the load is reduced to 1 kg. The number of cycles of the 5A programme to which the sample is subjected is determined by the end use of the product. In the case of intermediate products, tops are made up into yarn of a given count; yarns (including those made from the forementioned top) are made up into single jersey fabric of a standard cover factor. The single jersey knitted fabric is then tested according to the principles indicated above.

Alternatively, the anti-felting improvement corresponds to a felt-ball density at or below 0.04, measured according to the Aachen felt-ball test IWTO-20-69. This test was developed at the Deutsche Wollforschungsinstitut, Aachen, in 1960, and is applicable to wool and mixtures of wool and synthetic fibers which can be brought into a loose condition. The principle of the test is the following: 1 g wool and 50 ml of a buffer (pH 7) is placed in a standard 150 ml steel beaker which is then shaken three-dimensionally for a given period of time. The loose wool will form a ball, and the diameter of the felt ball is measured. The larger the felting tendency of the wool is, the smaller is the measured diameter of the resulting felt ball, and the higher is the density.

In the present context, the term "whiteness" is intended to mean how white the wool is or looks by visual determination. The degree of whiteness can conveniently be measured in a Datacolor 3890 Spectral photometer (CIELAB system).

More specifically, the present invention provides a method for producing wool or animal hair material having improved whiteness. It is believed that the improved whiteness is due to the enzymatic treatment step which leads to an improvement of the degree of whiteness of the enzymatically treated wool.

Preferably, the thus improved whiteness of wool or animal hair material treated in the Delhey process followed by an enzymatic treatment corresponds to an improvement in whiteness degree of at least 10 CIE units, more preferably of at least 12 CIE units, measured in the Datacolor 3890 Spectral photometer (CIELAB system).

Also, the improved whiteness of plasma and enzyme treated wool or animal hair material corresponds to an improvement in whiteness degree of at least 8 CIE units, more preferably of at least 10 CIE units, measured in the Datacolor 3890 Spectral photometer (CIELAB system).

In the present context, the terms "dye-uptake" or "dyestuff absorption" are intended to mean the capability of wool immersed in a dye bath to absorb the available soluble dyestuff.

More specifically, the present invention provides a method for producing wool or animal hair material having improved dye-uptake or dyestuff absorption. It is believed that the improved dye-uptake or dyestuff absorption is partly due to the enzymatic treatment step which leads to an improvement of the capability of the enzymatically treated wool to absorb the dyestuff.

Preferably, the improved dyeability of the produced wool or animal hair material corresponds to an increase of the colour depth by at least 2 DL (units), more preferably at least 3 DL (units), measured relative to a reference after competitive dyeing in 2% Lanasol Blue 8G.

In the present context, the term "loss of bundle strength tenacity" is intended to mean the reduction of the bundle strength tenacity of a fiber bundle material, i.e. wool or animal hair material, which is a result e.g. of any modifications or damages suffered during processes such as dyeing, bleaching and conventional shrink-proof treatments.

More specifically, the present invention provides a method for producing wool or animal hair material with improvement of one or more of the mentioned properties and with a limited loss of bundle strength tenacity.

Preferably, the loss of bundle strength of the wool or animal hair material subjected to the method of the present invention corresponds to a difference in bundle strength tenacity of the produced wool or animal hair material and bundle strength tenacity of the untreated material of less than 20%, more preferably less than 10%, especially less than 6%, measured according to IWTO-32-82(E). This standard which was prepared by the "Bundle Strength of Fibres" Working Group of the IWTO Technical Committee and adopted in 1979 is intended for the determination of the tenacity of wool in the form of bundles of parallel fibres in the direction of extension, with a jaw separation of 3.20 mm, 5.00 mm or 10.00 mm.

Further, the present invention provides a method for producing wool or animal hair material of improved softness, preferably a softness at least corresponding to the softness of untreated wool.

In the present context, the term "reduced pilling tendency" is intended to mean a permanent (and excellent) resistance to formation of pills on the surface of the treated wool or animal hair material in comparison with corresponding material which has not been subjected to the method of the present invention. The tendency to pilling formation may be tested according to the Swiss norm SN 198525, published in 1990 by Schweizerische Normen-Vereinigung, Kirchenweg 4, Postfach, CH-8032 Zürich, Switzerland, which describes a test of pilling-resistance for textiles which in turn is based on the Swiss norms SNV 95 150 (Textiles—Standard climatic conditions and test conditions for the physical tests under standard climate conditions) and SN 198 529 (Testing of textiles—"Scheuerfestigkeit"—Martindale method). The results of the test is expressed in terms of "pilling notes" which is a rating on a scale from pilling note 1 (heavy pill formation) to pilling note 5 (no or very little pill formation), allowing ½ pilling notes.

In another aspect, the present invention provides a method for producing wool or animal hair material having a reduced pilling tendency.

The Substrate Material

The method of the invention can be applied to any desirable animal hair product. The commercially most interesting animal hair is wool, e.g. from sheep, camel, rabbit, goat, lama, i.e. such as merino wool, shetland wool, cashmere wool, alpaca wool, mohair.

The wool or animal hair material subjected to the method of the invention can be top, fiber, yarn, or woven or knitted fabric. The treatment with proteolytic enzymes can also be carried out on loose flock or on garment made from wool or animal hair material which has previously been plasma treated.

It should be emphasized that wool and other animal hair are products of biological origin. The material may vary greatly e.g. in chemical composition and structure depending on the living conditions and health of the animal. Accordingly, the effect(s) obtained by subjecting wool or other animal hair products to the method of the present invention may also vary in accordance with the properties of the starting material.

The Process

Basically, the present invention is carried out in two steps.

The plasma treatment step is a low-temperature treatment, preferably a corona discharge treatment or a glow discharge treatment, vide supra.

This low-temperature plasma treatment is carried out by using a gas, preferably a gas selected from the group consisting of air, oxygen, nitrogen, ammonia, helium, or argon. Conventionally, air is used but it may be advantageous to use any of the other indicated gasses.

Preferably, the low-temperature plasma treatment is carried out at a pressure between about 0.1 torr and 5 torr for from about 2 seconds to about 300 seconds, preferably for about 5 seconds to about 100 seconds, more preferably from about 5 seconds to about 30 seconds.

The Delhey process is described in J. Delhey: PhD Thesis RWTH Aachen 1994; and in DE-A-43 32 692 and is carried out as follows:

The wool is treated in an aqueous solution of hydrogen peroxide (0.1–35% (w/w), preferably 2–10% (w/w)), in the presence of a 2–60% (w/w), preferably 8–20% (w/w) of a catalyst (preferably $Na_2WO_4$), and in the presence of a nonionic wetting agent. Preferably, the treatment is carried out at pH 8–11, and room temperature. The treatment time depends on the concentrations of hydrogen peroxide and catalyst, but is preferably 2 minutes or less.

After the oxidative treatment, the wool is rinsed with water.

For removal of residual hydrogen peroxide, and optionally for additional bleaching, the wool may be treated further in acidic solutions of reducing agents (sulphites, phosphites etc.).

The enzyme treatment step is preferably carried out for between about 1 minute and about 120 minutes; preferably at a temperature of between about 20° C. and about 60° C., more preferably between about 30° C. and about 50° C. Alternatively, the wool can be soaked in or padded with an aqueous enzyme solution and then subjected to steaming at a conventional temperature and pressure, typically for about 30 seconds to about 3 minutes.

The proteolytic enzyme treatment is carried out in an acidic or neutral or alkaline medium which may include a buffer.

It may be advantageous to carry out the enzyme treatment step in the presence of one or more conventional anionic, non-ionic or cationic surfactants. An example of a useful nonionic surfactant is Dobanol (from Henkel AG).

Further, the wool or animal hair material may be subjected to an ultrasound treatment, either prior to or simultaneous with the treatment with a proteolytic enzyme. The ultrasound treatment may advantageously be carried out at a temperature of about 50° C. for about 5 minutes.

It is contemplated that the reaction rate of the enzyme treatment step can be increased by increasing the temperature of the enzyme bath during the treatment, i.e. the total treatment time can be reduced.

The amount of proteolytic enzyme used in the enzyme treatment step is preferably between about 0.2 w/w % and about 10 w/w %, based on the weight of the wool or animal hair material.

It is to be understood that, to reduce the number of treatment steps, the enzyme treatment can be carried out during dyeing or scouring of the wool or animal hair material, simply by adding the protease to the dyeing, rinsing or scouring bath.

Preferably, the enzyme treatment is carried out after the plasma treatment but the two treatment steps may also be carried out vice versa.

It should be noted that the handle of plasma treated wool or animal hair is generally harsher than that of untreated wool. The enzyme treatment provides a softer handle, due to weight loss, and a reduction of stiffness of the fibres. Also, the enzyme treatment may improve the uptake of softeners, thereby improving the softening effect of additional treatments with softeners. The softness obtained by enzymatic treatment and softening agents is more durable than that obtained with softening agents alone.

It is also well-known that plasma treatment or Delhey treatment may provide a certain shrink-proofing. The degree thereof is increased after an enzyme treatment. It is believed that the plasma treatment or Delhey treatment provides the oxidation and lipid removal necessary for the access of protease to the wool fibre surface.

It has been established that plasma treatment and Delhey treatment have several advantages for the dyeing properties of wool. One of these advantages is the faster absorption of dyestuff at lower temperatures and an improved dye-bath exhaustion. The dye absorption is further improved by the enzyme treatment.

The Enzyme

A useful proteolytic enzyme for the method of the present invention is any enzyme having proteolytic activity at the actual process conditions. Thus, the enzyme may be a proteolytic enzyme of plant origin, e.g. papain, bromelain, ficin, or of animal origin, e.g. trypsine and chymotrypsine, or of microbial origin, i.e. bacterial or fungal origin or from yeasts. It is to be understood that any mixture of various proteolytic enzyme may be applicable in the process of the invention.

In a preferred embodiment of the invention, the proteolytic enzyme is a serine-protease, a metallo-protease, or an aspartate-protease. A serine protease is an enzyme which catalyzes the hydrolysis of peptide bonds, and in which there is an essential serine residue at the active site. They are inhibited by diisopropylfluorophosphate, but in contrast to metalloproteases, are resistant to ethylene diamino tetraacetic acid (EDTA) (although they are stabilized at high temperatures by calcium ions). They hydrolyze simple terminal esters and are similar in activity to eukaryotic chymotrypsin, also a serine protease. A more narrow term, alkaline protease, covering a sub-group, reflects the high pH optimum of some of the serine proteases, from pH 9.0 to 11.0 The serine proteases usually exhibit maximum proteolytic activity in the alkaline pH range, whereas the metalloproteases and the aspartate-proteases usually exhibit maximum proteolytic activity in the neutral and the acidic pH range, respectively.

A sub-group of the serine proteases are commonly designated as subtilisins. A subtilisin is a serine protease produced by Gram-positive bacteria or fungi. The amino acid sequence of a number of subtilisins have been determined, including at least six subtilisins from Bacillus strains, namely, subtilisin 168, subtilisin BPN, subtilisin Carlsberg, subtilisin DY, subtilisin amylosacchariticus, and mesentericopeptidase, one subtilisin from an actinomycetales, thermitase from *Thermoactinoomyces vulgaris*, and one fungal subtilisin, proteinase K from *Tritirachium album*. A further subgroup of the subtilisins, subtilases, have been recognised more recently. Subtilases are described as highly alkaline subtilisins and comprise enzymes such as subtilisin PB92 (MAXACAL®, Gist-Brocades NV), subtilisin 309 (SAVINASE®, Novo Nordisk A/S), and subtilisin 147 (ESPERASE®, Novo Nordisk A/S).

In the context of this invention, a subtilisin variant or mutated subtilisin protease means a subtilisin that has been produced by an organism which is expressing a mutant gene derived from a parent microorganism which possessed an original or parent gene and which produced a corresponding parent enzyme, the parent gene having been mutated in order to produce the mutant gene from which said mutated subtilisin protease is produced when expressed in a suitable host.

These mentioned subtilisins and variants thereof constitute a preferred class of proteases which are useful in the method of the invention. An example of a useful subtilisin variant is a variant of subtilisin 309 (SAVINASE®) wherein, in position 195, glycine is substituted by phenylalanine (G195F or $^{195}$Gly to $^{195}$Phe).

Conveniently, conventional fermented commercial proteases are useful. Examples of such commercial proteases are Alcalase® (produced by submerged fermentation of a strain of *Bacillus licheniformis*), Esperase® (produced by submerged fermentation of an alkalophilic species of Bacillus), Rennilase® (produced by submerged fermentation of a non-pathogenic strain of *Mucor miehei*), Savinase® (produced by submerged fermentation of a genetically modified strain of Bacillus), e.g. the variants disclosed in the International Patent Application published as WO 92/19729, and Durazym® (a protein-engineered variant of Savinase®). All the mentioned commercial proteases are produced and sold by Novo Nordisk A/S, DK-2880 Bagsvaerd, Denmark. Other preferred serine-proteases are proteases from Nocardiopsis, Aspergillus, Rhizopus, *Bacillus alcalophilus, B. cereus, N. natto, B. vulgatus, B. mycoide*, and subtilins from Bacillus, especially proteases from the species Nocardiopsis sp. and *Nocardiopsis dassonvillei* such as those disclosed in the International Patent Application published as WO 88/03947, especially proteases from the species Nocardiopsis sp., NRRL 18262, and *Nocardiopsis dassonvillei*, NRRL 18133. Yet other preferred proteases are the serine proteases from mutants of Bacillus subtilins disclosed in the International Patent Application No. PCT/DK89/00002 and in the International Patent Application published as WO 91/00345, and the proteases disclosed in EP 415 296 A2.

Another preferred class of proteases are the metalloproteases of microbial origin. Conveniently, conventional fermented commercial proteases are useful. Examples of such a commercial protease is Neutrase® (Zn) (produced by submerged fermentation of a strain of *Bacillus subtilis*), which is produced and sold by Novo Nordisk A/S.

Other useful commercial protease enzyme preparation are Bactosol™ WO and Bactosol™ SI, available from Sandoz A G, Basle, Switzerland; Toyozyme™, available from Toyo Boseki Co. Ltd., Japan; and Proteinase K™ (produced by submerged fermentation of a strain of Bacillus sp. KSM-K16), available from Kao Corporation Ltd., Japan.

The Softeners

It may be desirable to treat the wool or animal hair material with a softening agent, either simultaneous with the treatment with a proteolytic enzyme or after the plasma treatment and treatment with a proteolytic enzyme. The softener treatment may be necessary in cases where most of the natural fatty matter of the fibre surface has been removed e.g. as a result of the scouring or plasma treatment. Thus, in order to eliminate a possible dry, harsh handle of the fibre, it may be required to re-apply a low concentration of fatty material to the fibre surface in the form of a softener or softening agent.

The softeners conventionally used on wool are usually cationic softeners, either organic cationic softeners or silicone based products, but anionic or non-inoc softeners are also useful.

Examples of useful softeners are polyethylene softeners and silicone softeners, i.e. dimethyl polysiloxanes (silicone oils), H-polysiloxanes, silicone elastomers, aminofunctional dimethyl polysiloxanes, aminofunctional silicone elastomers, and epoxyfunctional dimethyl polysiloxanes, and organic cationic softeners, e.g. alkyl quarternary ammonium derivatives.

The invention is further illustrated in the following non-limiting examples.

EXAMPLE 1

In this working example, the effects on the property of materials were described by the following methods:

Shrinkage: IWTO-20-69: Method for determination of the felting properties of loose wool and top. A reduced felt-ball density corresponds to less felting.

Degree of whiteness: W-CIE (from 1986). The more positive the resulting CIE number is, the more white is the wool (−0.3 is more positive than −5).

Dyeability: Dyeing of samples:

The samples were immersed into a dyeing solution of 2% (w/v) Lanasol Blau 8G (from Giba-Geigy), with liquor ratio 1:13. The dye-bath was brought to the boiling point, and held at boiling temperature for 10 min. Samples were then washed once with tap water and once with distilled water, and dried. Sample and reference were dyed in the same dye-bath (competitive dyeing).

Colorimetric Evaluation of Colour Differences:

The colour of the samples was evaluated in terms of CIE-LAB/D65 coordinates by means of a Datacolor Tex flash 200. The sample coordinates were registered as difference values relative to the corresponding reference. A more negative DL value refers to a darker shade; a more positive DH value refers to a more blue shade.

The applied scoured wool top was 20 $\mu$m merino, with pH value of 9.7, and a degree of whiteness (W-CIE) of −10.7.

Four different plasma-enzyme processes were tested. In all processes, the plasma and enzyme treatment of the invention was carried out as follows:

Plasma Treatment

The wool was initially subjected to a low-temperature plasma treatment with the following parameters:

Excitation frequency: 4–5 kHz

Pressure: 1 mbar

Time: 20 sec.

Gas: air.

Enzyme Treatment

The pretreated wool was immersed into phosphate solution (0.1 M; pH 8), liquor ratio 1:20. After immersion,

*Nocar-diopsis* sp., NRRL 18262, protease was added to the liquor at a dosage of 0.12 g/kg wool. The enzyme was allowed to act for 45 min respectively 120 min at 50° C., then the wool was washed in water and dried. In all cases, a plasma treated reference sample was prepared by a corresponding treatment in buffer only.

Process No. 1

Enzyme treatment directly after plasma treatment.

Results:

| Treatment time: | Degree of whiteness (CIE) | Colorimetric evaluation after dyeing test (CIELAB/D65) | Felt-ball density (g/cm$^3$) |
|---|---|---|---|
| 45 min | | | |
| Reference | −6.4 | — | 0.126 |
| Enzyme treated | −0.3 | DL = −3.2<br>DH = 0.7 | 0.098 |
| 120 min | | | |
| Reference | −11.2 | — | 0.113 |
| Enzyme treated | −2.8 | DL = −6.8<br>DH = 6.0 | ≦0.041 |

Process No. 2

With the purpose of removing adjacent material from the plasma treated wool before the enzyme treatment, an ultra sound treatment was carried out between the plasma and enzyme treatment:

Treatment medium: Pure water

Liquor ratio: 1:20

Temperature: 40° C.

Frequency: 35 kHz

Treatment time: 5 min

Then washing, drying, and enzyme treatment.

Results:

| Treatment time: | Degree of whiteness (CIE) | Colorimetric evaluation after dyeing test (CIELAB/D65) | Felt-ball density (g/cm$^3$) |
|---|---|---|---|
| 45 min | | | |
| Reference | −5.7 | — | 0.115 |
| Enzyme treated | −4.5 | DH = 2.4 | 0.104 |
| 120 min | | | |
| Reference | −9.9 | — | 0.112 |
| Enzyme treated | −2.8 | DL = −8.1<br>DH = 4.4 | ≦0.041 |

Process No. 3

In order to remove material adhering to the surface of the plasma treated wool before the enzyme treatment, a surfactant treatment was carried out between the plasma and enzyme treatment:

Treatment medium: 0.1% Dobanol (nonionic surfactant from Henkel AG) in water

Liquor ratio: 1:20

Temperature: 40° C.

Treatment time: 5 min

Then washing, drying, and enzyme treatment.

Results:

| Treatment time: | Degree of whiteness (CIE) | Colorimetric evaluation after dyeing test (CIELAB/D65) | Felt-ball density (g/cm$^3$) |
|---|---|---|---|
| 45 min | | | |
| Reference | −4.8 | — | 0.102 |
| Enzyme treated | −3.3 | DH = 0.9 | 0.087 |
| 120 min | | | |
| Reference | −9.0 | — | 0.102 |
| Enzyme treated | 0.6 | DL = −3.1<br>DH = 4.6 | 0.050 |

Process No. 4

For removal of adjacent material from the plasma treated wool before the enzyme treatment, an ultra sound treatment with surfactant was carried out between the plasma and enzyme treatment:

Treatment medium: 0.1% Dobanol in water

Liquor ratio: 1:20

Temperature: 40° C.

Frequency: 35 kHz

Treatment time: 5 min

Then washing, drying, and enzyme treatment.

Results:

| Treatment time: | Degree of whiteness (CIE) | Colorimetric evaluation after dyeing test (CIELAB/D65) | Felt-ball density (g/cm$^3$) |
|---|---|---|---|
| 45 min | | | |
| Reference | −5.1 | — | 0.101 |
| Enzyme treated | −3.2 | DL = −4.2<br>DH = 2.5 | 0.088 |
| 120 min | | | |
| Reference | −6.5 | — | 0.098 |
| Enzyme treated | 2.1 | DL = −6.5<br>DH = 5.7 | ≦0.041 |

The results shown in the tables of the processes 1–4 demonstrate that the enzyme treatment in all cases resulted in increased whiteness, increased colour depth, and felting reduction.

EXAMPLE 2

I.1 Wool Material a) Plasma treated and reference wool knitted fabric. The fabric parameters were as follows:

fineness: 24 $\mu$m yarn count: tex 25×1 cover factor: 0.71 knitted on circular-knitting machine Maxi Jack (Trabal, Spain)

fabric weight 250 g/m$^2$ standard finishing procedure (scouring, stenter dyeing, decatizing)

dry cleaning (to remove all softeners, surface active agents)

treatment in air plasma: treatment time 60s, voltage ~800 V, current 2.2 A b) Untreated woven fabric, plain weave, for fastness testing. Area weight 127 g/m$^2$.

I.2 Enzyme Material

The enzyme used was protease NOVOZYM 654 from Novo Nordisk A/S, DK-2880 Bagsvaerd, batch 94-12.

I.3 Enzyme Treatment

The enzyme treatment was performed in dyeing machines. The samples were either prepared according to IWS test method 31 and then enzyme treated or the samples were first enzyme treated and then prepared according to IWS 31.

In the first case the samples were of double thickness and 300 mm×400 mm in size sewn together at the edges. The samples were enzymatically treated in the Ahiba Turbomat 1000. 500 ml Tris-(hydroxymethyl)-aminomethane-acetate buffer pH 8 were added to 65 g of the knitted and sewn sample (liquor ratio 1:7.7) 0.166% (owf) NOVOZYM 654 were incubated with the wool at a temperature of 50° C. for 120 min (resp. 60 min). The inactivation of the enzyme was performed at 85° C. for 10 min. The samples were rinsed with tap water for 20 min. References were treated under the same conditions with buffer without addition of enzyme.

In the second case the knitted fabric was enzymatically treated as one piece in the Ahiba Turbocolor dyeing machine. The liquor ratio was 1:7.9 and the rinsing was performed in the dyeing machine for 30 min. Besides these conditions the treatment parameters were equal to those given above. After the enzyme treatment fabric pieces at a size of 225×300 mm were sewn together and prepared for IWS TM 31.

In the case of woven fabric 300×300 mm samples were prepared in single layer. A cuff was formed prior to the TM 31 test by folding two sides along lines 20 mm from the edge.

I.4 The Delhey Process /1/

Immediately prior to the use the treatment solution was prepared as follows: 50 ml $H_2O_2$ (35% v/v) and 53 g $Na_2WO_4 \times 2\ H_2O$ in 550 ml $H_2O$ with 3 g Laventin LNB (BASF) (corresponding to 20 g fabric) were mixed together. 15 s later a sample of woven fabric was wetted in the solution and squeezed in a foulard to a weight increase of 75%. After a reaction time of 2 min the sample was rinsed under tap water and air dried.

I.5 IWS Test Method 31

The dimension measurements were performed after relaxation (1×7A), after felting shrinkage (2×5A) and after felting shrinkage (5×5A). Sample sizes according to I.3.

I.6 Determination of the Weight Loss

The weight loss of the samples was determined by measuring the dry weight of the samples prior to and after the enzyme or buffer treatment. Part of the samples were dried at 110° C. for 4 h, cooled down in a desiccator and weighed.

I.7 Degree of Whiteness

The degree of whiteness was measured at a Datacolor 3890 colorimeter (Datacolor, Marl, Germany). The degree of whiteness is given as W-CIE.

I.8 Dye Uptake

Fabrics were dyed with 2% Lanasol Blue 8G in small batches (4 ml, 2×200 mg woven fabric, 2×500 mg knitted fabric, 10' at 100° C.). The buffer respectively untreated and the enzyme treated samples were dyed in competition. The colour measurements were performed at the Datacolor 3890 calorimeter. The values given are difference values DL (colour depth).

I.8 Wettability Testing (Drop testing /2/)

Destilled water (0.25 g) is dropped from a height of 40 mm onto the stretched fabric and the time is stopped when the drop is fully soaked (no more reflectance on the surface). A mean value of 3 measurements was taken.

II. Results

II.1 Determination of the Relaxation and Felting Shrinkage in Washing of the Wool Samples II.1.1 Plasma Treated Knitted Wool Fabric Samples The results of the relaxation and felting shrinkage of the 225×300 mm of size plasma treated wool samples treated with enzymes respectively buffer are listed in Table 1 (1×7A, 2×5A) and Table 2 (1×7A, 5×5A).

TABLE 1

Relaxation (1 × 7A) and felting shrinkage (2 × 5A) of the plasma treated wool samples treated with 0.166% (owf) NOVOZYM 654 respectively buffer for 120 min (sample size 225 × 300 mm)

| | Relaxation/% | | Felting shrink-age % | | Area shrinkage/% | | Total shrin- | |
|---|---|---|---|---|---|---|---|---|
| Samples | Width | Length | Width | Length | Relaxa-tion | Shrink-age | kage/% | X/% |
| Reference | 4.78 | −11.32 | 1.11 | −17.54 | −6.00 | −16.24 | −22.24 | |
| fabric | 5.95 | −11.92 | 0.01 | −17.05 | −5.26 | −17.04 | −22.30 | −22.27 |
| Plasma | 5.90 | −12.27 | 5.90 | −12.62 | −5.65 | −5.98 | −11.63 | |
| treated fabric | 5.72 | −12.27 | 6.23 | −12.69 | −5.85 | −5.67 | −11.52 | −11.6 |
| Plasma + | 5.08 | −8.09 | 5.32 | −12.13 | −2.60 | −6.16 | −8.76 | |
| buffer | 4.09 | −7.99 | 4.69 | −10.77 | −3.57 | −5.57 | −9.14 | −8.95 |
| Plasma + | 5.29 | −8.36 | 3.95 | −8.45 | −2.63 | −4.17 | −6.80 | |
| enzyme | 3.77 | −6.63 | 4.35 | −9.23 | −2.61 | −4.48 | −7.09 | −6.95 |

TABLE 2

Relaxation (1 × 7A) and felting shrinkage (5 × 5A) of the plasma treated wool samples treated with 0.166% (owf) NOVOZYM 654 respectively buffer for 120 min (sample size 225 × 300 mm)

| | Felting shrinkage/% | | Area shrinkage/% | | Total shrink- | |
|---|---|---|---|---|---|---|
| Samples | Width | Length | Relaxa-tion | Shrink-age | age/% | X/% |
| Reference | −10.80 | −30.39 | −6.00 | −44.47 | −50.47 | 50.20 |
| | −10.73 | −30.63 | −5.26 | −44.65 | −49.91 | |
| Plasma | 1.89 | −18.06 | −5.65 | −15.83 | −21.48 | |
| | 2.33 | −17.00 | −5.85 | −14.30 | −20.15 | −20.82 |
| Plasma + | 7.87 | −18.22 | −2.60 | −8.92 | −11.52 | |
| buffer | 7.37 | −18.20 | −3.57 | −9.49 | −13.06 | −12.30 |
| Plasma + | 6.32 | −12.72 | −2.63 | 5.60 | −8.23 | |

TABLE 2-continued

Relaxation (1 × 7A) and felting shrinkage (5 × 5A) of the plasma treated wool samples treated with 0.166% (owf) NOVOZYM 654 respectively buffer for 120 min (sample size 225 × 300 mm)

| | Felting shrinkage/% | | Area shrinkage/% | | Total | |
|---|---|---|---|---|---|---|
| Samples | Width | Length | Relaxa-tion | Shrink-age | shrink-age/% | X/% |
| enzyme | 6.88 | −14.02 | −2.61 | −6.18 | −8.79 | −8.51 |

The relaxation and felting shrinkage of the bigger wool samples are listed in Tables 3 and 4.

From these results it can be deduced that the enzyme treatment leads to an additional reduction of the felting shrinkage of plasma treated wool. In the case of the 225×300 mm samples the additional reduction amounts to 40% (22.8% for the buffer treatment) and in the case of the 300×400 mm samples it amounts to 61% (21% for the buffer treatment) for the 2×5A testing. But also in the case of the reference knitted wool fabric the felting shrinkage is reduced by the enzyme treatment.

Plasma treated and reference knitted fabric samples (300×400 mm, double sewn) were also treated with 0.83% of Novozym 654 for 120 and 60 min. The results of the relaxation and felting shrinkage are listed in Tables 5a–d.

TABLE 3

Relaxation (1 × 7A) and felting shrinkage (2 × 5A) of the reference/plasma treated wool samples treated with 0.166% (owf) NOVOZYM 654 respectively buffer for 120 min (sample size 300 × 400 mm)

| | Relaxation/% | | Felting shrinkage % | | Area shrinkage/% | | Total | |
|---|---|---|---|---|---|---|---|---|
| Samples | Width | Length | Width | Length | Relaxa-tion | Shrink-age | shrin-kage/% | X/% |
| Reference + buffer | 3.74 | −6.21 | 0.90 | −16.76 | −2.24 | −15.71 | −17.95 | |
| Plasma + buffer | 2.28 | −4.86 | 6.01 | −13.50 | −2.47 | −6.68 | −9.15 | |
| Ref. + | 2.84 | −3.95 | 1.95 | −14.21 | −1.0 | −11.98 | −12.98 | |
| enzyme | 1.20 | −3.69 | 4.56 | −15.72 | −2.45 | −10.44 | −12.89 | −12.94 |
| Plasma + | 2.11 | −4.26 | 4.34 | −7.45 | −2.06 | −2.79 | −4.85 | |
| enzyme | 1.93 | −3.29 | 5.79 | −9.25 | −1.29 | −2.92 | −4.21 | −4.53 |

TABLE 4

Relaxation (1 × 7A) and felting shrinkage (5 × 5A) of the reference/plasma treated wool samples treated with 0.166% (owf) NOVOZYM 654 respectively buffer for 120 min (sample size 300 × 400 mm)

| | Felting shrinkage/% | | Area shrinkage/% | | Total | |
|---|---|---|---|---|---|---|
| Samples | Width | Length | Relaxa-tion | Shrink-age | shrink-age/% | X/% |
| Reference + buffer | −11.09 | −27.36 | −2.24 | −41.5 | −43.74 | |
| Plasma + buffer | 2.30 | −20.16 | −2.47 | −17.4 | −19.87 | |
| Ref. + | −7.15 | −24.75 | −1.00 | −33.67 | −34.67 | |
| enzyme | −5.23 | −25.46 | −2.45 | −32.02 | −34.47 | −34.57 |
| Plasma + | 5.56 | −11.84 | −2.06 | −5.62 | −7.68 | |
| enzyme | 6.19 | −13.94 | −1.29 | −6.89 | −8.18 | −7.93 |

TABLE 5a

Relaxation (1 × 7A) and felting shrinkage (2 × 5A) of the reference/plasma treated wool samples treated with 0.83% (owf) NOVOZYM 654 respectively buffer for 120 min (sample size 300 × 400 mm)

| | Relaxation/% | | Felting shrinkage/% | | Area shrinkage/% | | Total | |
|---|---|---|---|---|---|---|---|---|
| Samples | Width | Length | Width | Length | Relaxation | Shrinkage | shrinkage/% | X/% |
| Reference + buffer | 2.23 | −6.15 | 1.02 | −18.05 | −3.78 | −16.85 | −20.63 | |
| Plasma + buffer | 1.64 | −6.77 | 7.32 | −10.17 | −5.02 | −2.11 | −7.13 | |
| Ref. + | 2.08 | −6.17 | 3.41 | −15.24 | −4.96 | −11.31 | −16.27 | |
| enzyme | 1.72 | −5.65 | 3.04 | −14.48 | −3.45 | −11.00 | −14.45 | −15.36 |
| Plasma + | 1.72 | −5.55 | 4.85 | 10.31 | −3.73 | −4.96 | −8.69 | |
| enzyme | 3.38 | −6.68 | 4.00 | −8.47 | −3.07 | −4.13 | −7.20 | −7.95 |

TABLE 5b

Relaxation (1 × 7A) and felting shrinkage (2 × 5A) of the reference/plasma treated wool samples treated with 0.83% (owf) NOVOZYM 654 respectively buffer for 60 min (sample size 300 × 400 mm)

| | Relaxation/% | | Felting shrinkage/% | | Area shrinkage/% | | Total | |
|---|---|---|---|---|---|---|---|---|
| Samples | Width | Length | Width | Length | Relaxation | Shrinkage | shrinkage/% | X/% |
| Reference + buffer | 1.99 | −5.57 | 0.87 | −17.33 | −3.47 | −16.31 | −19.78 | |
| Plasma + buffer | 1.18 | −7.60 | 6.00 | −11.83 | −6.33 | −5.12 | −11.45 | |
| Reference + | 0.85 | −4.18 | 4.30 | −14.92 | −3.29 | −9.98 | −13.27 | |
| enzyme | 1.10 | −1.19 | 2.89 | −16.87 | −0.08 | −13.49 | −13.57 | −13.42 |
| Plasma + | 4.00 | −6.30 | 3.70 | −7.56 | −2.05 | −3.58 | −5.63 | |
| enzyme | 1.27 | −4.77 | 5.46 | −7.79 | −3.44 | −1.90 | −5.34 | −5.49 |

TABLE 5c

Relaxation (1 × 7A) and felting shrinkage (5 × 5A) of the reference/plasma treated wool samples treated with 0.83% (owf) NOVOZYM 654 respectively buffer for 120 min (sample size 300 × 400 mm)

| | Felting shrinkage/% | | Area shrinkage/% | | Total | |
|---|---|---|---|---|---|---|
| Samples | Width | Length | Relaxation | Shrinkage | shrinkage/% | X/% |
| Reference + buffer | −9.91 | −29.41 | −3.78 | −42.23 | −46.01 | |
| Plasma + buffer | 7.69 | −16.22 | −5.02 | −7.28 | −12.30 | |
| Ref. + | −5.01 | −24.13 | −4.96 | −30.35 | −35.31 | |
| enzyme | −5.50 | −24.73 | −3.45 | −31.59 | −35.04 | −35.2 |
| Plasma + | 8.78 | −14.68 | −3.73 | −4.61 | −8.34 | |
| enzyme | 5.96 | −11.56 | −3.07 | −4.91 | −7.98 | −8.2 |

TABLE 5d

Relaxation (1 × 7A) and felting shrinkage (5 × 5A) of the reference/plasma treated wool samples treated with 0.83% (owf) NOVOZYM 654 respectively buffer for 60 min (sample size 300 × 400 mm)

| | Felting shrinkage/% | | Area shrinkage/% | | Total | |
|---|---|---|---|---|---|---|
| Samples | Width | Length | Relaxation | Shrinkage | shrinkage/% | X/% |
| Reference + buffer | −12.09 | −29.63 | −3.47 | −45.30 | −48.77 | |
| Plasma + buffer | 5.70 | −18.35 | −6.33 | −11.60 | −17.93 | |
| Reference + | −3.60 | −24.91 | −3.29 | −29.41 | −32.70 | |
| enzyme | −3.24 | −25.77 | −0.08 | −32.36 | −32.44 | −32.6 |
| Plasma + | 8.16 | −13.42 | −3.44 | −4.16 | −7.60 | |
| enzyme | 5.72 | −12.39 | −2.05 | −5.96 | −8.01 | −7.8 |

In the case of the (2×5A) testing the reduction of shrinkage caused by the enzyme treatment of the untreated wool fabric amounts to 25%. In the case of the incubation of plasma treated wool with 0.83% of Novozym for 120 min the shrinkage was not reduced but even slightly enhanced. On the contrary if the treatment time is reduced to 60 min with 0.83% Novozym 654 the total shrinkage is reduced by 50%. Using higher enzyme concentrations the treatment time is decisive for the antifelting effect.

II.1.2 Woven Fabric Treated According to the Delhey Process

These trials were carried out on woven fabric. The results of the relaxation and felting shrinkage of the 300×300 mm (280×280 mm) of size Delhey samples treated with enzymes/buffer are shown in Table 6.

TABLE 6a

Relaxation (1 × 7A) and felting shrinkage (2 × 5A) of Delhey or untreated samples treated with 0.166% (owf) NOVOZYM 654 or buffer, respectively (sample size 280 × 280 mm)

| | Relaxation/% | | Felting shrink-age % | | Area shrinkage/% | | Total shrin- | |
|---|---|---|---|---|---|---|---|---|
| Samples | Width | Length | Width | Length | Relaxa-tion | Shrink-age | kage/% | X/% |
| Untreated | −2.53 | −2.63 | −12.00 | −8.88 | −5.23 | −21.95 | −27.18 | |
| reference | −2.69 | −2.72 | −12.49 | −7.70 | −5.48 | −21.15 | −26.63 | −26.91 |
| Delhey | 0.24 | −1.60 | −2.30 | −5.16 | −1.36 | −7.58 | −8.94 | |
| treated reference | −0.24 | −1.09 | −2.23 | −4.90 | −1.33 | −7.24 | −8.55 | −8.75 |
| Buffer | 0.05 | −0.89 | −1.34 | −3.62 | −0.84 | −5.01 | −5.85 | |
| treated Delhey (120') | 0.35 | −0.85 | −1.52 | −4.21 | −0.50 | −5.79 | −6.29 | −6.07 |
| Buffer treated | 0.24 | −0.24 | 0 | −1.96 | −0 | −1.96 | −1.96 | |
| Delhey (120') 0.166% | 0.90 | 0.05 | 0 | −1.89 | 0.95 | −1.89 | −0.94 | −1.45 |

TABLE 6b

Relaxation (1 × 7A) and felting shrinkage (5 × 5A) of the Delhey or untreated samples treated with 0.166% (owf) NOVOZYM 654 respectively buffer (sample size 280 × 280 mm)

| | Felting shrinkage/% | | Area shrinkage/% | | Total shrin- | |
|---|---|---|---|---|---|---|
| Samples | Width | Length | Relaxa-tion | Shrink-age | kage/% | X/% |
| Untreated | −31.10 | −28.02 | −5.23 | −67.83 | −73.06 | |
| reference | −31.19 | −25.98 | −5.48 | −65.27 | −70.75 | −71.9 |
| Delhey | −12.02 | −16.31 | −1.36 | −30.29 | −31.65 | |
| treated reference | −10.83 | −16.92 | −1.33 | −29.58 | −30.91 | −31.3 |
| Buffer | −8.41 | −11.81 | −0.84 | −21.21 | −22.05 | |
| treated Delhey (120') | −10.61 | −14.50 | −0.50 | −26.65 | −27.15 | −24.6 |
| Enzyme treated | −1.80 | −7.00 | −0 | −8.93 | −8.93 | |
| Delhey (120') 0.166% | −1.50 | −6.52 | 0.95 | 8.11 | −7.16 | −8.0 |

2×5A: The treatment according to Delhey reduces the total shrinkage of the woven fabric used already by approximately 70%. By the enzyme treatment (120 min., 0.166% owf enzyme) the shrinkage is further reduced by >80%. The total reduction of shrinkage achieved with the combined process amounts to 95%.

II.2 Degree of Whiteness

The two different sample dimensions of the knitted fabric result from the realization that in the case of the 300×400 mm samples (of double thickness) the rinsing by tap water after the enzyme treatment was less effective, documented in the lower degree of whiteness of the enzyme treated samples (Table 7a) and in a weight increase after treatment (not documented). It seems that residual enzyme and protein fragments were inactivated but not completely removed from the fabric.

Therefore wool samples were treated and rinsed in single fabric thickness.

Furthermore, the rinsing was performed in the Ahiba Turbocolor machine where the tap water is pressed through the fabric (Table 7b).

In Table 7c the results of the whiteness measurements for the woven fabric samples treated according to Delhey/1/ and enzyme/buffer posttreated are listed.

TABLE 7

Degree of whiteness of the plasma treated, reference and enzyme posttreated material

| a) 300 × 400 mm, knitted fabric treated and washed double sewn: time, enzyme conc. | W-CIE | ΔW-CIE | X |
|---|---|---|---|
| references | | | |
| untreated | 2.3 | — | |
| plasma | 1.4 | — | |
| 120 min., 0.166% owf | | | |
| untreated | 1.9 | −0.4 | |
| | 1.9 | −0.4 | −0.4 |
| plasma | 0.3 | −1.1 | |
| | 0.5 | −0.9 | −1.0 |
| 60 min., 0.83% owf | | | |
| untreated | −2.2 | −4.5 | |
| | −2.1 | −4.4 | −4.5 |
| plasma | −2.9 | −4.3 | |
| | −2.0 | −3.4 | −3.9 |
| 120 min., 0.83% owf | | | |
| untreated | −2.8 | −5.1 | |
| | −2.2 | −4.5 | −4.8 |
| plasma | −2.2 | −3.6 | |
| | −3.3 | −4.7 | −4.2 |
| references, buffer treated 120' | | | |
| untreated | −0.1 | −2.4 | |
| plasma | 0.5 | −0.9 | |

TABLE 7-continued

| Degree of whiteness of the plasma treated, reference and enzyme posttreated material | | |
|---|---|---|
| 60' | | |
| untreated | −0.1 | −2.4 |
| plasma | 0.6 | −0.8 |
| b) 225 × 300 mm, knitted fabric treated in single layer and washed in double layer | | |
| samples | W-CIE | ΔW-CIE |
| plasma treated reference | 1.4 | — |
| buffer treated plasma fabric (120') | 1.7 | 0.3 |
| enzyme treated plasma fabric (120', 0.166% owf Novozym 654) | 4.0 | 2.6 |
| c) Delhey process, woven fabric 280 × 280 mm | | |
| samples | W-CIE | ΔW-CIE |
| reference untreated | 15.5 | — |
| reference Delhey treated | 9.6 | −5.9 |
| buffer treated Delhey (120') | 15.8 | 0.3 |
| enzyme treated Delhey (120', 0.166% owf Novozym 654) | 27.8 | 12.3 |

In contrast to the samples enzymatically treated in double layer, the plasma treated knitted wool samples treated in one layer with enzymes show an enhanced degree of whiteness compared to the reference.

After the Delhey process (performed as given in I.4) the degree of whiteness of the samples is lower than that of the corresponding reference. The values are increased again by the following buffer treatment and after the enzyme treatment the degree of whiteness is increased by ΔW-CIE value of 12.3.

II.3 Dyeability of the Samples

Fabrics treated were dyed with Lanasol Blue 8G in competition with the corresponding reference and the colour differences (DL values) of the respective sample pairs were measured (Table 8).

TABLE 8

| Colour differences of the samples and references dyed in competition | |
|---|---|
| Samples corresponding reference/sample | DL |
| Woven fabric | −10.2 |

TABLE 8-continued

| Colour differences of the samples and references dyed in competition | |
|---|---|
| Samples corresponding reference/sample | DL |
| untreated/Delhey treated | |
| buffer treated Delhey/-enzyme treated Delhey | −7.1 |
| Delhey treated/-enzyme treated Delhey | −4.0 |
| Knitted fabric | |
| Untreated/enzyme treated | −6.1 |
| Plasma/buffer treated plasma 120' | −3.6 |
| Buffer treated plasma/-enzyme treated plasma (0.166%, 120') | −0.5 |

The biggest difference in the dye uptake is observed in the case of the Delhey treated fabric compare d to the untreated fabric. The enzyme treated Delhey samples show a higher uptake than the Delhey treated reference.

In the case of the plasma treated samples the dye uptake is further enhanced by the enzyme treatment.

II.4 Evaluation of the Handle

In general the handle of the enzyme treated samples is better than that of the reference. Thus, a tendency is visible and perceptible with rising enzyme concentration, the samples become softer. In these cases the treatment time plays a minor role.

II.5 Wettability

The samples that were used in the dyeing test (II.3) were also tested for wettability (Table 9). In this test it be came obvious that either the plasma treatment or the capillary forces along the fabric were not equal. It could also be possible that the dry cleaning prior to the plasma treatment was not effective enough. In the case of the only plasma treated knitted fabric e.g., 3 different values for soaking were measured (11.33 mi, 10 sec, 5.45 min). Both sides of the fabric were tested. The fabric is he terogeneous regarding the wettability. Only in the case of the enzyme posttreated plasma treated fabric the soaking was rapid and equal (50, 45 and 42 sec). But, only for one side of the fabric. During the enzyme treatment the fabric was rolled up round the support in the dyeing machine. Thus, part of the fabric is more exposed to the liquor although the liquor is pumped (outside to inside) through the roll. This might be the reason for the different wetting behaviour of the enzyme posttreated samples.

The samples treated by the Delhey process do not show a rapid soaking. But the wettability is enhanced compared to the untreated reference.

TABLE 9

Results of the wettability testing of the differently treated wool samples

| | I | II | III | IV | V | VI | VII | VIII | IX |
|---|---|---|---|---|---|---|---|---|---|
| 1 | ∞ | ∞ | 50 sec | >10 min | 11.33 min | >10 min | >10 min | >10 min | >10 min |
| 2 | ∞ | ∞ | 45 sec | >10 min | 10 sec | >10 min | >10 min | >10 min | |
| 3 | ∞ | ∞ | 42 sec | >10 min | 5.45 min | >10 min | >10 min | >10 min | |
| x | ∞ | ∞ | 46 sec | >10 min | | >10 min wetted below drop | >10 min wetted below drop | >10 min wetted below drop | >10 min wetted below drop |

Knitted fabric: I–V
I: enzyme treated (0.166%, 120 min)
II: untreated
III: enzyme treated plasma fabric (0.166%, 120 min)
IV: buffer treated plasma fabric (120 min)
V: plasma treated
Woven fabric: VI–IX
VI: enzyme treated Delhey fabric (0.166%, 120 min)
VII: buffer treated Delhey (120 min)
VIII: Delhey treated
IX: untreated

What is claimed is:

1. A method of producing wool or animal hair material with improved properties comprising the steps of a. treating wool, wool fibres or animal hair material using a plasma treatment process, and b. subjecting the wool, wool fibres, or animal hair material treated in step (a) to a treatment with a proteolytic enzyme in an amount effective for improving the properties, with the proviso that the wool, wool fibres, or animal hair are not treated with a shrink-proofing resin between steps (a) and (b) and wherein said improved properties are selected from the group consisting of an improved shrink-proof property, an improved anti-felting property, an improved whiteness degree, an improved dyeability, a reduced loss of bundle strength, an improved softness, and a reduced pilling tendency.

2. The method according to claim 1, wherein the plasma treatment is a low-temperature treatment selected from the group consisting of a corona discharge treatment and a glow discharge treatment.

3. The method according to claim 1, wherein the improved property of the produced wool or animal hair material is an improved shrink-proof or anti-felting property wherein said improved shrink-proof property comprises an area shrinkage of less than 10% after 2 cycles of ISO 5A, or an area shrinkage of less than 15% after 5 cycles of ISO 5A, wherein said area shrinkage is measured according to the IWS Test Method 31; and wherein said improved anti-felting property comprises a felt-ball density at or below 0.04, measured according to the Aachen felt-ball test IWTO-20-69.

4. The method according to claim 1, wherein the improved property of the produced wool or animal hair material is an improved shrink-proof or anti-felting property wherein said improved shrink-proof property comprises an area shrinkage of less than 25% after 2 cycles of ISO 5A, or an area shrinkage of less than 20% after 5 cycles of ISO 5A, wherein said area shrinkage is measured according to the IWS Test Method 31.

5. The method according to claim 1, wherein the improved property is an improved whiteness degree, wherein said improved whiteness degree comprises an improvement of at least 8 CIE units as measured in a Datacolor 3890 Spectral photometer.

6. The method according to claim 5, wherein said improved whiteness degree comprises an improvement of at least 10 CIE units.

7. The method according to claim 1, wherein the improved property of the produced wool or animal hair material is an improved dyeability, wherein said improved dyeability comprises an increase of the colour depth by at least 2 DL units measured relative to an untreated reference after competitive dyeing in 2% Lanasol Blue 8G.

8. The method according to claim 1, wherein the loss of bundle strength tenacity of the produced wool or animal hair material, as compared to the bundle strength tenacity of the untreated material is less than 20% measured according to IWTO-32-82.

9. The method according to claim 1, wherein the improved property of the produced wool or animal hair material is improved softness.

10. The method according to claim 1, wherein the improved property of the produced wool or animal hair material is a reduced pilling tendency.

11. The method according to claim 2, wherein the low-temperature plasma treatment is carried out by using a gas selected from the group consisting of air, oxygen, nitrogen, ammonia, helium, and argon.

12. The method according to claim 2, wherein the low-temperature plasma treatment is carried out for from about 2 seconds to about 300 seconds and at a pressure between about 0.1 torr and 5 torr.

13. The method according to claim 1, wherein the treatment with a proteolytic enzyme is carried out for between about 1 minute and about 120 minutes and at a temperature of between about 20° C. and about 70° C.

14. The method according to claim 1, wherein the treatment with a proteolytic enzyme is carried out in an acidic or neutral or alkaline medium, optionally in the presence of one or more anionic, non-ionic or cationic surfactants.

15. The method according to claim 1, wherein the wool or animal hair material is further subjected to an ultrasound treatment, either prior to or simultaneous with the treatment with a proteolytic enzyme.

16. The method according to claim 1, wherein the wool or animal hair material is subjected to a treatment with a softener or softening agent, either simultaneous with the treatment with a proteolytic enzyme or after the plasma treatment and treatment with a proteolytic enzyme.

17. The method according to claim 1, wherein the proteolytic enzyme is of plant or animal origin.

18. The method according to claim 1, wherein the proteolytic enzyme is selected from the group consisting of a bacterial protease, a fungal protease and a protease producible by or derivable from yeasts.

19. The method according to claim 18, wherein the proteolytic enzyme is a serine protease.

20. The method according to claim 19, wherein the serine protease is selected from the group consisting of subtilisin PB92, subtilisin 309 and subtilisin 147.

21. The method according to claim 19, wherein the serine protease is a variant of subtilisin 309 having the glycine in position 195 substituted with phenylalanine (G195F).

22. The method according to claim 19, wherein the serine protease is producible by or derived from a strain selected from the group consisting of *B. licheniformis, B. alcalophilus, B. cereus, B. natto, B. vulgatus* and *B. mycoide.*

23. The method according to claim 19, wherein the serine protease is a protease producible by or derivable from a strain belonging to a genus selected from the group consisting of Nocardiopsis, Aspergillus, Rhizopus and Mucor.

24. The method according to claim 23, wherein the protease is producible by or derivable from a strain of Nocardiopsis sp. or *Nocardiopsis dassonvillei.*

25. The method according to claim 1, wherein the amount of proteolytic enzyme is between about 0.2 w/w % and about 10 w/w %, based on the weight of the wool or animal hair material.

26. Wool or animal hair material which has been treated according to the method of claim 1.

* * * * *